United States Patent [19]

Denneboom

[11] Patent Number: 4,594,942

[45] Date of Patent: Jun. 17, 1986

[54] BALING PRESS WITH LARGE SUPPLY HOPPER

[75] Inventor: Else M. Denneboom, Boekelo, Netherlands

[73] Assignee: B.V. Machinefabriek BOA, Netherlands

[21] Appl. No.: 701,035

[22] Filed: Feb. 12, 1985

[51] Int. Cl.[4] ..... B30B 7/04

[52] U.S. Cl. ..... 100/137; 100/190; 100/215; 100/233; 100/295

[58] Field of Search ..... 100/137, 139, 143, 144, 100/179, 190, 215, 232, 233, 240, 295

[56] References Cited

U.S. PATENT DOCUMENTS 3,521,553 7/1970 Smolka .
3,752,061 8/1973 Hirsch ..... 100/215 X
3,805,689 4/1974 Berger ..... 100/215 X
4,059,049 11/1977 Tillgren ..... 100/137 X
4,121,515 10/1978 Tea ..... 100/232 X

*Primary Examiner*—Billy J. Wilhite
*Attorney, Agent, or Firm*—Stevens, Davis, Miller & Mosher

[57] ABSTRACT

A baling press having a main pressing box of rectangular shape with a side pressing box along one edge. The side pressing box has a plunger for moving material into the main pressing box. A hopper is above the boxes and between the hopper and the boxes is a pre-pressing unit having a pair of doors, each in the form of a quarter section of a cylinder which press material from the hopper downwardly into the boxes for subsequent compression and removal by a pressing plunger which moves along the longitudinal axis of the main box.

3 Claims, 6 Drawing Figures

BALING PRESS WITH LARGE SUPPLY HOPPER

Figure 1:
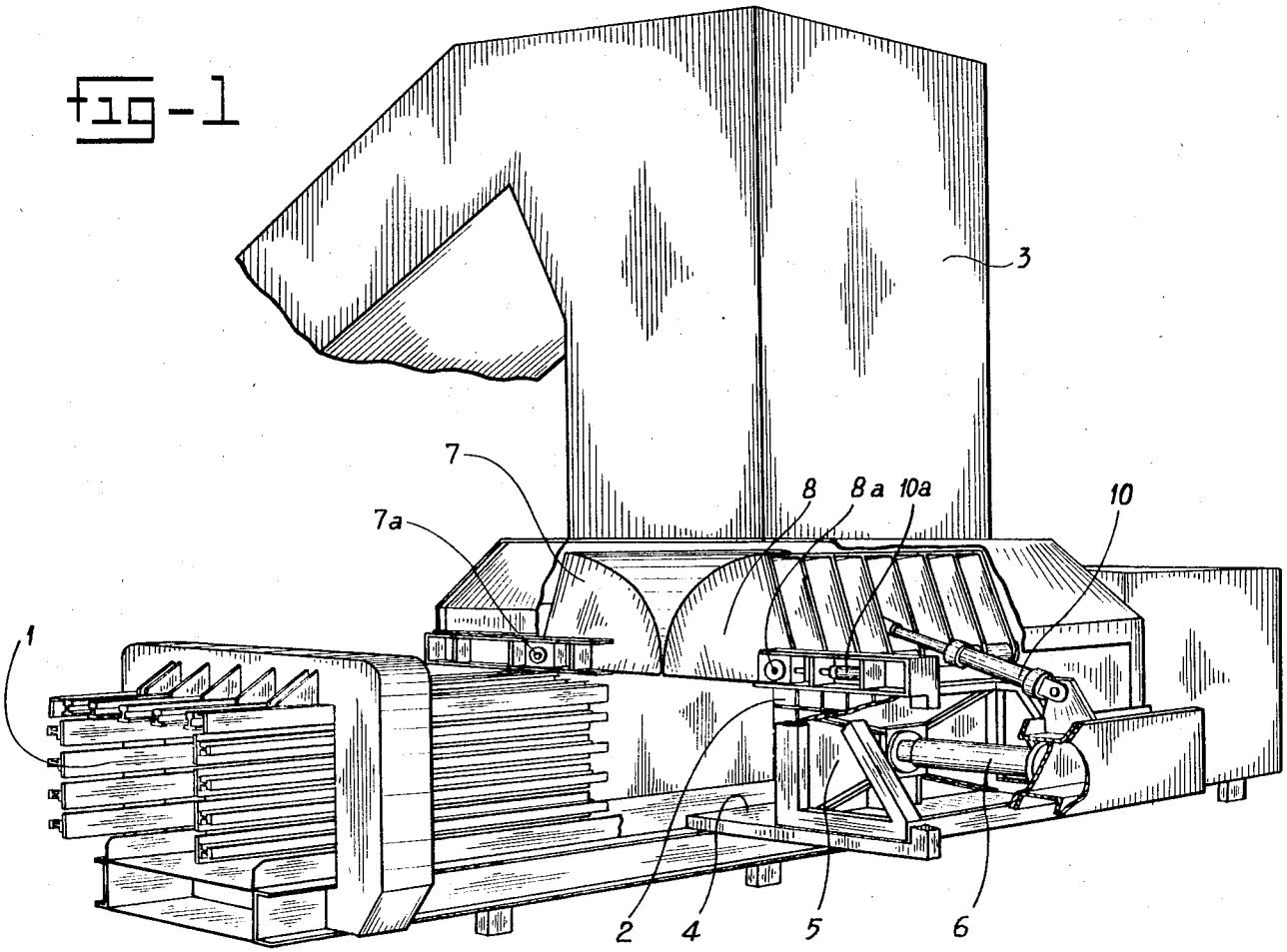

The invention relates to a baling press comprising a substantially horizontal pressing box with a substantially rectangular cross-section, a pressing plunger movable to and fro within said pressing box, a supply hopper for the material especially waste material to be baled above the pressing box through a passage in the upper wall of the pressing box in communication with the pressing box, a pre-pressing unit consisting of at least one quarter of a cylinder rotatable around a horizontal axis in the centre of the cylinder, which quarter of a cylinder contains at least one flat rectangular pressing face.

Such a baling press for waste material, such as paper, cardboard, plastics or the like, is known from EP-A-0 080 719. This known baling press is provided with a supply hopper with a large horizontal cross-section, so that cardboard boxes and the like can be thrown directly in the supply hopper without the necessity of first shredding by hand or in a separate shredder.

At the known baling press the large supply hopper extends not only above the passage in the upper wall of the horizontal pressing box but also above a part of the closed upper wall. When waste material, such as cardboard or the like is thrown in the supply hopper only a small part of it will fall directly through the relatively small passage in the pressing box. The remaining part remains upon the upper wall of the pressing box.

The rectangular pressing face of the quarter of a cylinder is in a vertical plane during filling nearly in one plane with a vertical wall of the supply hopper.

In this position after filling the quarter of a cylinder is moved now parallel to itself by means of a drive member such as a hydraulic cylinder.

Then the material is pre-pressed somewhat in sideward direction within the supply hopper, till the vertical pressing face of the quarter of a cylinder is lying above the passage in the horizontal pressing box. This is the first pre-pressing step. The cross-section of the supply hopper after this first prepressing step is equal to the passage to the pressing box.

Now the quarter of a cylinder is rotated, till the vertical pressing face is in the horizontal position in one plane with the upper wall of the pressing box. This now is the second pre-pressing step. The passage is closed now. The material is present now under a certain prepressing pressure within the pressing box and is pressed now to a bale in horizontal direction by means of the pressing plunger.

The invention aims to improve this known baling press and this is obtained in that perpendicular to the pressing box, called main pressing box, a side pressing box is connected to the main pressing box, in which side pressing box a side pressing plunger is movable to and fro, in that the passage from the supply hopper is as large as the horizontal cross-section of the supply hopper which passage extends in the upper wall of the main pressing box and in the upper wall of the side pressing box and in that the axis (axes) of the quarter(s) of a cylinder has (have) substantially a fixed position and is (are) parallel to the longitudinal direction of the main pressing box.

According to the invention the quarter(s) of a cylinder is (are) only used for pre-pressing downwards the material within the supply hopper till the passage is closed. The side pressing plunger provides then the second pre-pressing step till the material is present completely within the main pressing box.

Thus, the passage for the waste material from the supply hopper to the pressing box is always as large as the horizontal cross-section of the supply hopper and this waste material can thus fall partly direct from the supply hopper in the pressing boxes.

In the known baling press the material must first be pre-pressed sidewards within the supply hopper, whereby the quarter of the cylinder has to be moved over a certain distance parallel to itself.

At a preferred embodiment of the invention whereby two quarters of a cylinder are used, the axis of one of them is lying in one of the side walls of the supply hopper and the axis of the other quarter of a cylinder is lying in the other side wall of the supply hopper on the spot of the boundary of the passage in the side pressing box, while the rotational movement of both quarters of a cylinder being synchronously but in opposite directions.

By applying two quarters of a cylinder rotating toward each other during the first pre-pressing step it is avoided that the material to be pressed is clamped against one of the sidewalls of the supply hopper.

By using two quarters of a cylinder as according to the present invention the material to be pressed is guided to the centre of the supply opper and is gradually cut.

To prevent that even with two quarters of a cylinder clamping occurs according to the invention it is proposed, that the axis of the quarters of a cylinder lying on the spot of the boundary of the passage in the side pressing box can step aside in horizontal direction parallel to itself against spring force or the like.

The invention will now be explained with reference to the drawings, in which:

FIG. 1 is a schematic side view of the bailing press according to the invention, partly broken away; and FIGS. 2, 3, 4, 5 and 6 show schematically the different pressing steps.

The baling press according to the present invention comprises a horizontal, in cross section, rectangular main pressing box 1, in which a main present plunger 2 is movable to and fro by means of a non-shown hydraulic cylinder or the like.

The supply hopper is indicated with the reference number 3 and has in the horizontal plane a rectangular cross section. Suitable dimensions are 1600×1600 mm.

It is possible in such a large supply hopper 3 to throw cardboard boxes and the like without the necesity of shredding them before.

A short side pressing box 4 is connected perpendicularly to the main pressing box 1, in which a side pressing plunger 5 is movable to and fro by means of a hydraulic cylinder 6.

This side pressing box 4 has a rectangular cross section with the same height as the main pressing box 1. In fact from one side wall of the main pressing box 1 a part is cut away, to which the side pressing box 4 connects.

The left side wall of the supply hopper 3 is lying in one vertical plane with the left side wall of the main pressing box 1.

The right side wall of the supply hopper 3 is lying above the side pressing box 4.

The passage from the interior of the supply hopper 3 is formed by a rectangular opening in the upper wall of the main pressing box 1 and in the side pressing box 4 and has the same rectangular form and size as the horizontal cross section of the supply hopper 3.

For carrying out a first pre-pressing step two quarters of a cylinder 7 and 8 are present which can have the same form.

Each quarter of a cylinder 7, 8 comprises a cylindrical circumferential face and two rectangular radial faces.

The quarters of a cylinder 7,8 are rotatable around parallel horizontal axes *7a*, *8a*, which axes are respectively arranged in or near the left and the right side wall respectively of the supply hopper 3 and thus in or near two opposite boundaries of the rectangular passage.

Both quarters of a cylinder 7, 8 are coupled in such a way that they are rotated around their axes *7a*, *8a* respectively at the same time and in the same measure, but in opposite directions by means of the hydraulic cylinder 10.

Figure 2:
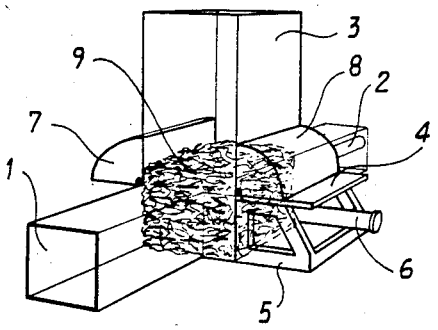
Figure 3:
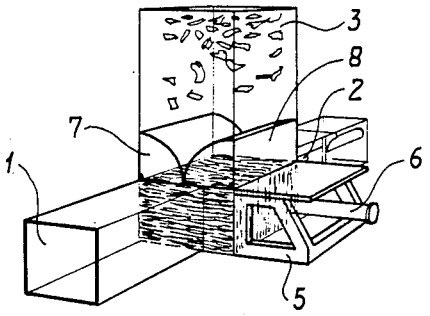

During rotating inwards of the quarters of a cylinder 7,8 from the position according to FIG. 2 to the position according to FIG. 3 the rectangular radial faces are moving from the vertical to the horizontal position. During this movement they are pressing down-wards the material 9 to be pressed which in the position according to FIG. 2 projects above the pressing boxes 1, 4 till within the pressing boxes, which now are closed at the upper side. This is the first pre-pressing step, whereby the side pressing plunger 5 is in the retracted position, see FIG. 2 and FIG. 3.

In order to prevent that the material 9 to be pressed during this first pre-pressing step is clamped between the two quarters of a cylinder 7, 8 the axis *8a* of the quarter of a cylinder 8 has means to move it parallel to itself. In this mean axis *8a* is supported by a hydraulic or pneumatic cylinder 10*a* or the like which is able to give a spring action.

Figure 4:
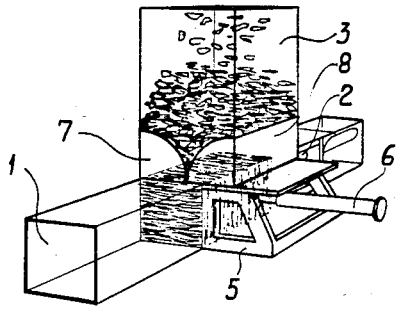
Figure 5:
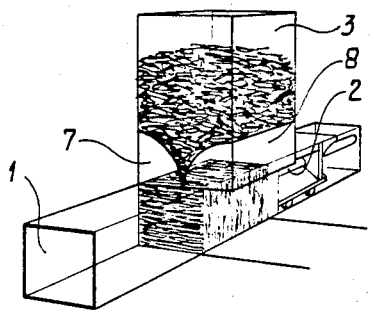
Figure 6:
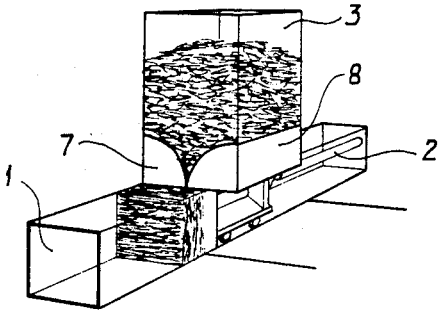

When the quaters of a cylinder 7, 8 are rotated about their axes and closed, see FIG. 3, throwing material 9 in the supply hopper 3 can be continued, see FIGS. 4, 5 and 6.

In the mean time pressing takes place in the side box 4, that means the side pressing plunger 5 is moving from the position according to FIG. 3 to the position according to FIG. 4. This is the second pre-pressing step.

All the material 9 lying below the quarters of a cylinder 7, 8 is present now in the main pressing box 1, which at the upper side is closed by the flat faces of the quarters of a cylinder 7, 8 and at the side by the front face of the side pressing plunger 5. Throwing material 9 in the supply hopper is continued. In FIG. 5 and FIG. 6 for the sake of clearness the side pressing box is cut away.

In the position according to FIG. 5 the main pressing plunger 2 is set in operation, this plunger is moving forwards and the material is pressed to a bale in a conventional way against an earlier pressed bale and provided with binding material (non-shown).

In the press according to the present invention throwing material in the supply hopper can always continue.

When the quarters of a cylinder 7, 8 are open, thus in the position according to FIG. 2 then the waste material can directly fall to the bottom of the pressing boxes. When it is assumed that in FIG. 2 the volume of the material is 4 $m^3$, then the volume at the first pre-pressing step will be reduced to 2.9 $m^3$ (FIG. 3). After the second pre-pressing step the volume is 2.1 $m^3$ (FIG. 4) and after the main pressing step the volume is 0.82 $m^3$ (FIG. 6). Of course, these values are only an example.

I claim:

1. A baling press comprising:

a substantially horizontal main pressing box having a substantially rectangular cross section;

a pressing plunger mounted for movement within the main pressing box in a direction parallel to the longitudinal axis thereof;

a side pressing box positioned along one side edge of the main pressing box and having a side pressing plunger mounted for movement within the side pressing box and in a direction generally perpendicular to the longitudinal axis of the main pressing box so that material within the side pressing box may be compressed into the main pressing box by movement of the side pressing plunger;

a supply hopper for material to be baled positioned above the main and side pressing boxes, the hopper being of rectangular shape and in communication with the interiors of both pressing boxes by a passage of the same size and shape as the horizontal cross section of the supply hopper;

a pre-pressing unit in said passage, said pre-pressing unit comprising two members each in the form of a quarter section of a cylinder, each quarter section having a rectangularly shaped plane face and an adjacent curved face, said members being mounted for rotation about their longitudinal axes with said axes being positioned generally parallel to the longitudinal axis of the main pressing box and each axis being generally in the same plane as one sidewall of the supply hopper, one of the members being above said side pressing box;

means for causing simultaneous rotation of said members about their axes so that upon a quarter turn of rotation the plane face of each member will move from a position substantially parallel with the hopper sidewalls to a position substantially perpendicular to said hopper sidewalls, the two plane faces thus forming a top wall on the main pressing box;

means for biasing the axis of the member which is above the side pressing box in a direction toward the other member.

2. The baling press of claim 1 in which said means for biasing is connected to move the axis of said member in a generally horizontal direction toward and away from the other member.

3. The baling press of claim 2 in which the biasing means is at least one fluid operated cylinder.

* * * * *